United States Patent [19]

Glasfeld et al.

[11] 4,106,423

[45] Aug. 15, 1978

[54] WEATHER COVERS FOR TANKERS

[75] Inventors: Rolf D. Glasfeld, Cohasset; Jan G. Morrill, Leominster, both of Mass.

[73] Assignee: General Dynamics Corporation, St. Louis, Mo.

[21] Appl. No.: 736,478

[22] Filed: Oct. 28, 1976

[51] Int. Cl.[2] ..... B63B 25/08

[52] U.S. Cl. ..... 114/74 A; 220/901; 52/80

[58] Field of Search ..... 220/9 LG, 9 R, 9 A, 220/9 D; 114/74 R, 74 A; 52/80, 81, 573; 403/220, 291, 28, 29, 50

[56] References Cited

U.S. PATENT DOCUMENTS

| | | | |
|---|---|---|---|
| 2,386,958 | 10/1945 | Jackson | 114/74 A |
| 2,800,249 | 7/1957 | Beckwith | 220/9 LG |
| 2,980,215 | 4/1961 | Englund | 52/80 |
| 3,215,301 | 11/1965 | Armstrong | 220/9 LG |
| 3,859,805 | 1/1975 | Johnson | 114/74 A |
| 3,924,367 | 12/1975 | Stewart | 52/80 |

*Primary Examiner*—Trygve M. Blix
*Assistant Examiner*—D. W. Keen
*Attorney, Agent, or Firm*—Fitch, Even, Tabin & Luedeka

[57] ABSTRACT

A liquid-transporting cargo ship has a hull which supports a main deck and several cargo tanks which extend above the main deck. A generally hemispherical cover surrounds the above-deck portion of each tank. The cover is formed of at least three self-supporting metal plating subsections, each of which is connected along its bottom edge to the main deck and along its lateral edges to a meridonal expansion member which is generally tubular in cross section. For cargo tanks designed to carry cryogenic liquid, the cover is made gastight, and an inert atmosphere is maintained in surrounding relation to each cargo tank.

14 Claims, 8 Drawing Figures

Fig. 1.
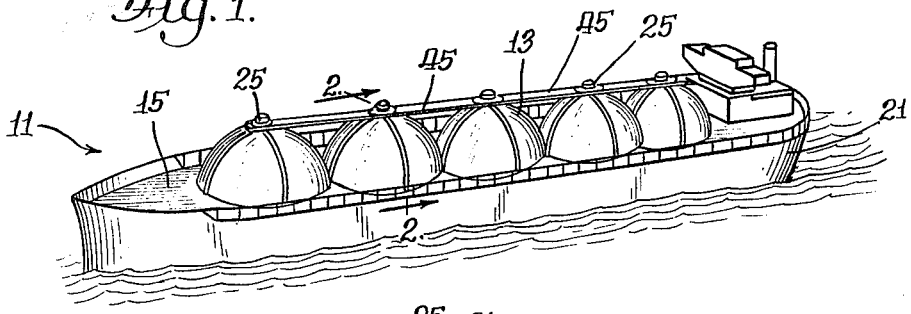
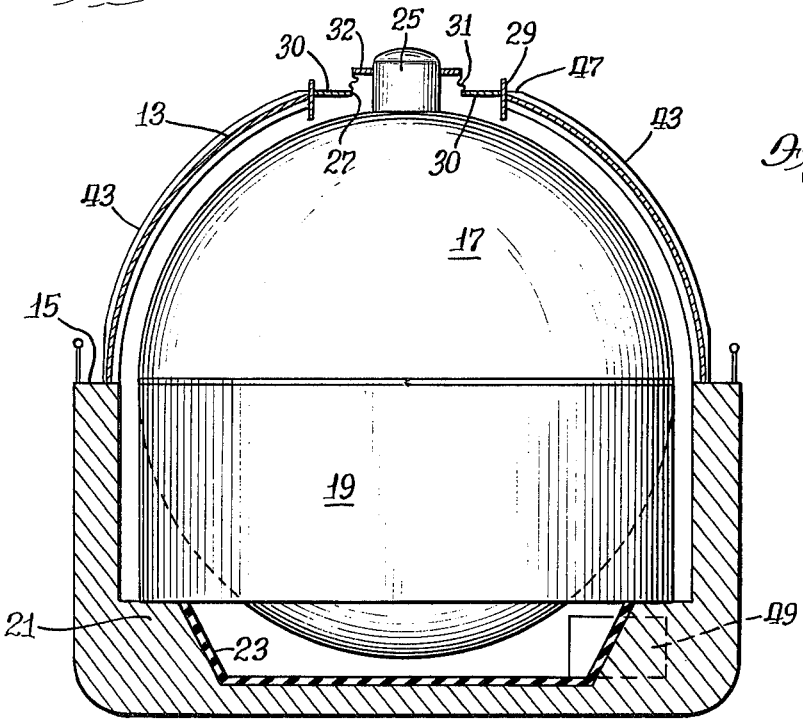
Fig. 2.
Fig. 3a.
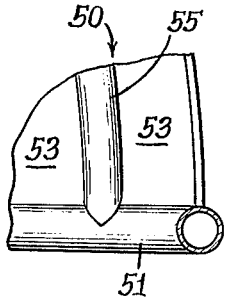
Fig. 3.
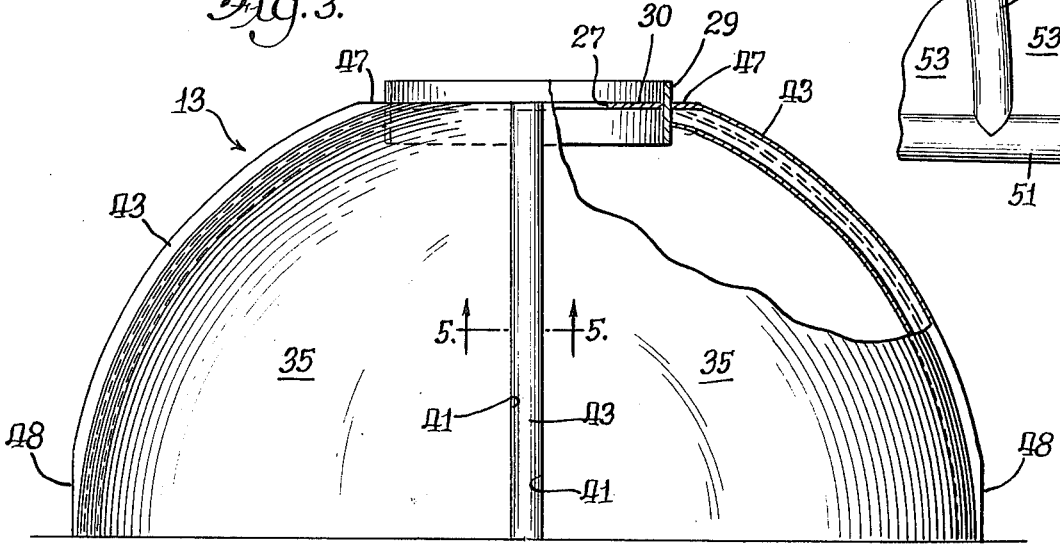

WEATHER COVERS FOR TANKERS

This invention relates to cargo ships and more particularly to weather covers for liquid tankers having large tanks which extend above the main deck.

Tankers have been used for a long time to transport oil, gasoline and other chemicals which are commonly stored at ambient temperature. It has recently been found practical, and commercially feasible, to transport cryogenic liquids in shipboard tanks. One particular use of such ships has been to transport liquified natural gas (LNG), which remains in liquid form at a temperature below about −162° C. at atmospheric pressure.

One of the several different types of ships that have been developed for carrying LNG utilizes large spherical tanks, and U.S. Pat. Nos. 3,841,269, issued Oct. 15, 1974 and 3,908,574, issued Sept. 3, 1975, are illustrative of this general type of ship. The construction of a ship of this type takes into consideration a number of factors not associated with standard oil tanker design, such as the change in dimensions which results from thermal contraction and expansion that occurs between the time when the tanks are full and at their cryogenic temperature and the time when they are empty and at ambient temperature, as for example, during inspection or perhaps during ballast voyage.

These large spherical tanks extend above the main or weather deck of the ship, and it is important that they be protected from the ocean salt spray and the like. Moreover, such tanks are thermally insulated, requiring an appropriate thermal barrier between the cryogenic temperature of the liquid within the tank and the ambient temperature of the surrounding oceanic atmosphere. It is also usually desired to maintain an inert atmosphere about the exterior of the LNG tanks.

Various types of weather covers have been proposed and used in such ships which incorporate spherical tanks. One such ship included large, generally cylindrical weather cover sections which fit over the uppermost portion of each tank, with lower cylindrical sections disposed between tanks, and with the cylindrical sections respectively interconnected by truncated conical sections. Other types of weather covers have been proposed which are generally hemispherical and which use heavy meridional support members having horizontally extending interconnections to create a supporting framework on top of which the cover plates are disposed.

It is an object of the present invention to provide an improved weather cover for liquid-carrying tanks that extend above the main deck of a ship. A further object is to provide an improved weather cover for protection of spherical cryogenic tanks installed on ships. Another object of the invention is to provide improved weather covers for spherical cryogenic tanks, which covers are of free-standing construction so that they can be built on land and then lifted aboard ship and appropriately installed above the tank in question. A still further object is to provide a weather cover of simple design which can provide a gas-tight jacket above a cryogenic tank and which will effectively withstand the stresses of ocean voyages. These and other objects of the invention will be apparent from the following detailed description of a preferred embodiment of the invention when read in conjunction with the accompanying drawings wherein:

FIG. 1 is a perspective view of a ship at sea which incorporates five large spherical tanks each of which is protected by an individual weather cover incorporating various features of the invention;

FIG. 2 is an enlarged vertical sectional view taken generally along the line 2—2 of FIG. 1;

FIG. 3 is an enlarged elevational view, with portions broken away, of one of the weather covers shown on the ship of FIG. 1;

Figure 4:
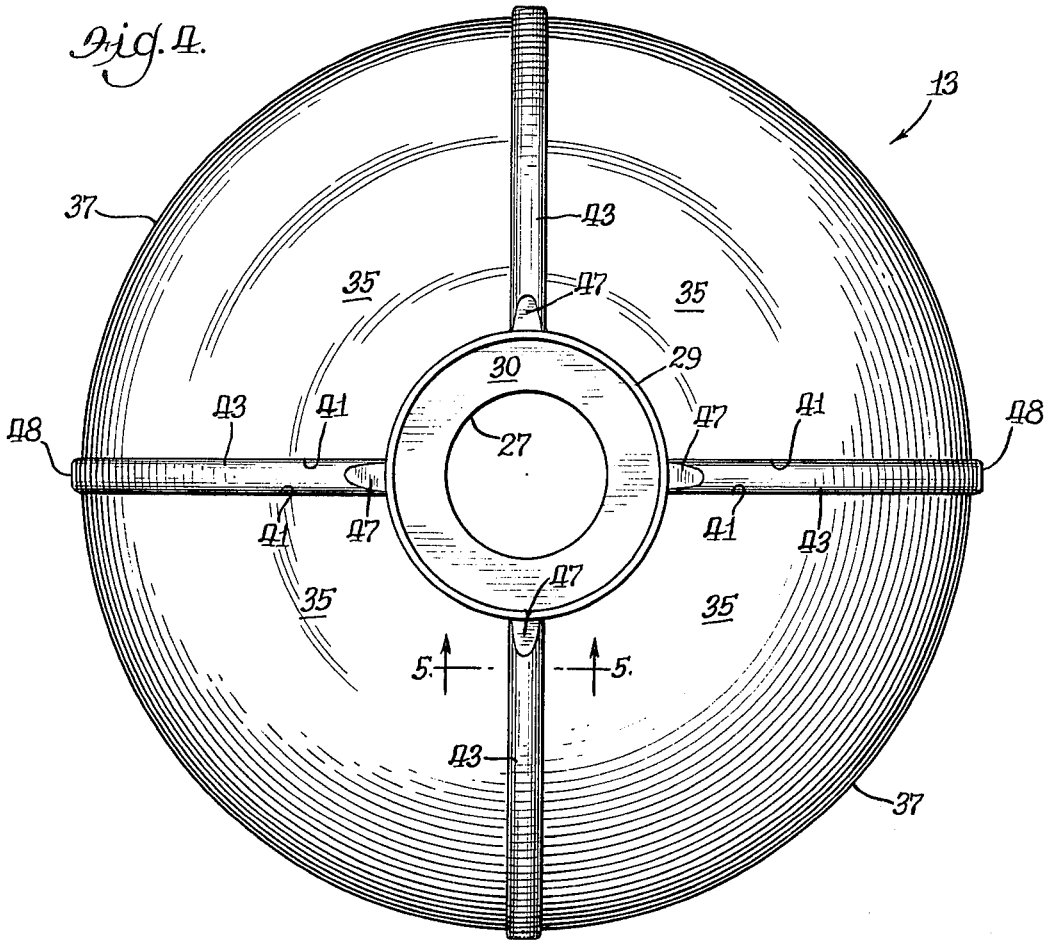
Figure 5:
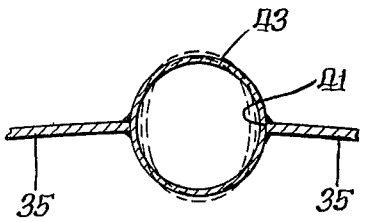
Figure 6:
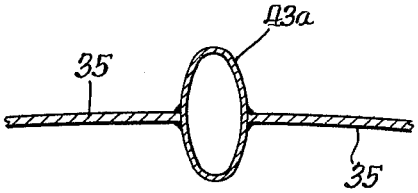
Figure 7:
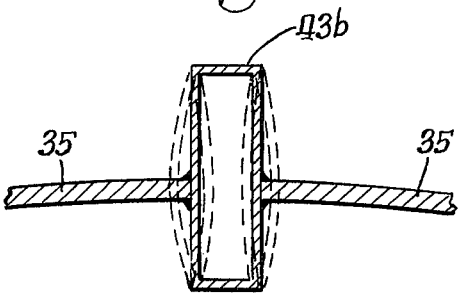

FIG. 3*a* is an enlarged fragmentary section view of an alternate embodiment of the weather cover shown in FIG. 3;

FIG. 4 is a plan view of the weather cover shown in FIG. 3;

FIG. 5 is an enlarged fragmentary sectional view taken along the line 5—5 of FIG. 4; and FIGS. 6 and 7 are views similar to FIG. 5 showing alternative constructions.

Basically, the invention provides a free-standing weather cover designed to cover the portion of a large spherical tank which protrudes above the main deck of an LNG tanker. The illustrated weather cover is a section of a hollow sphere which is divided into a plurality, i.e., at least three, of subsections and which subsections are interconnected by means of meridional expansion members. The individual cover subsections are free-standing entities, usually made of welded plates of appropriate thickness, and when interconnected with one another create the free-standing weather cover. The expansion members provide the resilience to absorb the deformations which result from the hogging and sagging of an ocean-going ship and which would otherwise have a destructive effect upon a totally rigid, unstiffened cover, and they are also capable of accommodating any changes in dimension which might result from thermal expansion and contraction.

Depicted in FIG. 1 is a ship 11 which contains five spherical tanks each of which is covered by protective weather cover 13. Each tank 17 is made of metal, preferably aluminum, and the weather cover 13 protects the upper portion of the tank 17 which extends above the main deck 15 of the ship.

As best seen in FIG. 2, each of the tanks 17 is spherical and is supported via an integral metal skirt 19 which is connected to the tank at about its equator. Although the structural details of the connection between the skirt and the tank are not shown, they may be of the general type disclosed in U.S. Pat. No. 2,901,592, issued to Rossheim on Aug. 25, 1959. The lower part of the metal skirt 19 is suitably connected, as by welding, to an appropriate location in the hull 21 of the ship 11. Although the tank 17 is illustrated with this preferred method of support via a skirt, it should be understood that various alternative support arrangements for a large spherical tank, which are shown in the art, may also be used.

If desired, a layer of insulation 23 may also be applied to the interior surface of the hull 21 below the spherical tank 17 so that, if any leakage should unexpectedly occur, the cryogenic liquid can be vaporized upon the insulation without endangering the hull. The spherical outer surface of the tank includes a covering of a appropriately thick layer of thermal insulation of a suitable material, such as foamed polyurethane, the exterior of which is covered with a suitable elastomeric vapor barrier, for example, butyl rubber, so that the tank 17 retains the smooth spherical appearance shown in FIG. 2. Alternatively, it may be possible to appropriately insulate the interior surface of the metal tank wall.

Each of the spherical tanks 17 is formed with a cupola or dome 25 at its top through which all of the piping connections are routed and through which there is manual access into the tank 17, for inspection purposes, for example, downward via a stairway provided in a central casing (not shown). As can be seen in FIGS. 1 and 2, the cupola 25 extends above the weather cover 13 through an opening 27 provided therein. Accordingly, the weather cover 13 is provided with a central upper ring member or collar 29 to the interior of which is connected an annular plate 30 wherein the opening 27 is formed that is sized so as to fit about the exterior of the cupola 25 and the piping connections protruding therefrom. As earlier indicated, the weather cover 13 is desirably self-supporting so that it can be constructed in the shipyard on land and then lifted by a crane for installation about the insulated cryogenic tank, after the tank has been installed in the hull 21 of the ship 11. Once in place in the ship hull, a suitable flexible seal 31 is installed between the annular plate 30 and an annular plate 32 of smaller dimension which is affixed to the cupola 25, to thus seal the region between the weather cover 13 and the exterior surface of the cupola 25 and insure gas tightness at this location, at least in those instances where it is desired to maintain an inert atmosphere in the region between the interior of the weather cover 13 and the exterior of the cryogenic tank 17.

The illustrated weather cover 13 has substantially the shape of a hollow hemisphere up to the central collar 29, although it has a height slightly less than the radius of the sphere because the equator of the spherical cryogenic tank lies well below (for example, about 13 feet below) the level of the main deck 15. The shape of the weather cover 13 is generally referred to as spheroidal which should be understood to mean that it can be precisely a section of a sphere but may also have the shape of some other surface of revolution or may only approximate either of these. Although the shape of the weather cover 13 preferably should match the surface of the upper portion of the cryogenic tank 17, so as to maintain a relatively uniform spacing therebetween and keep the volume which must be filled with inert gas desirably low, deviations from this relationship can be tolerated. Likewise, if for some reason the cryogenic tank itself did not have a precisely spherical upper section but instead had the shape of some other surface of revolution, there might be advantage in the weather cover having a matching shape; however, the weather cover 13 could also have the shape of a section of a sphere.

As best seen in FIG. 4, the weather cover 13 is made up of a plurality of subsections 35 which together constitute the spherical surface section. At least three subsections 35 are used, and it is unlikely that more than eight subsections would be employed. In the illustrated preferred embodiment, four quadrants are employed. Each of the four quadrants is a self-supporting subsection 35 and is suitably connected as by welding, to the main deck 15 along its bottom edge 37 and to the upper ring 29 along its upper edge 39. The upper ring or collar 29 may be formed from steel plate of appropriate width and thickness, which is bent to form a cylindrical surface having a diameter sufficient to accommodate the apertured plate 30 that provides clearance about the cupola 25. Each of the lateral edges 41 of each quadrant 35 is suitably joined, as by welding, to an expansion member 43 which extends from the main deck 15 to the central collar 29 and which accordingly has the same degree of axial curvature as the lateral edge of the quadrant 35.

As best seen in FIG. 5, the cross sectional shape of the illustrated expansion member 43 is circular, and the thickness of the metal from which the expansion member 43 is formed is generally less than the thickness of the plate from which the self-supporting quadrant 35 is formed. As can thus best be seen from FIG. 4, each expansion member 43 is welded, or otherwise suitably joined, to the lateral edges of two adjacent quadrants 35. The expansion members 43 primarily function to relieve deformations which are created as a result of shipboard movement. Because the outer surface of the weather cover 13 will always be at ambient temperature and because there will be insulation between it and the cryogenic liquid, substantial stresses should not be created in the weather cover as a result of change in temperature as long as all systems are working as planned.

The hogging and sagging of a ship of this length, which occurs in the fore-and-aft direction in heavy seas, places significant stresses upon structures, such as this, located above the main deck 15. It has been found that the employment of the four expansion members 43, which are aligned in meridional direction from the main deck 15 to the upper collar 29, effectively compensate for the tendency of the plate-like quadrants 35 to move in response to the hogging and sagging of the ship. The expansion members 43 thus relieve the potentially destructive stresses which would otherwise require such substantial reinforcement or such a greater thickness of the plate that a significant weight and fabrication penalty would result.

The expansion members 43 which are used have a cross sectional shape such that their sidewall portions, to which the lateral edges of the subsections 35 are attached can resiliently deflect toward and away from each other without causing any permanent deformation thereto. Shown in dotted lines in FIG. 5 is the deflection which the opposite sidewall portions of the circular expansion member 43 would undergo when subjected to compressive stresses. In those expansion members 43 where the stresses are in the opposite direction, the cross section would elongate instead of contracting in the direction shown. To obtain maximum effectiveness in this respect, it is believed that the weather cover 13 should be aligned aboard ship with two of the expansion members 43 aligned athwartship, and with the other two expansion members 43 accordingly lying fore-and-aft, as illustrated in FIG. 1. It is with this orientation that it is believed the best accommodation of deflections is accomplished by the expansion members 43. If, for example, only three subsections 35 were employed, then one of the expansion members 43 should be aligned fore-and-aft and the other two expansion members respectively disposed at 180° intervals.

The expansion members 43 are preferably generally tubular, and most preferably have a cross section which is a complete tube. Examples of some alternative tubular constructions are shown in FIGS. 6 and 7. In FIG. 6, an expansion member 43a is illustrated which has a cross section in the form of an elipse, the longer axis of which lies in the vertical plane. FIG. 7 shows a rectangular cross section tube 43*b* wherein again the longer dimension of the rectangle is in a vertical plane, and this construction has certain advantages over a tube having a cross section which is that of a circle or some other figure of revolution. An expansion member 43 having a cross section which is less than a complete tube may also be used; for example, a channel which resembles the FIG. 7 expansion member 43*b* with the bottom wall omitted or a member having the cross section of an inverted U may be used. Nontubular shapes which will have the requisite deflection characteristics may also be used; for example, the expansion member 43 could be Z-shaped or S-shaped in cross section.

However, the inward or outward deflection movement of the sidewall portions of such an open-tubular or nontubular expansion member 43 would result in some tendency towards rotation at the point of welding between the respective lateral edge of the platelike cover subsection 35 and the sidewall portion of the expansion member that might require additional strength at the lines of joinder. The dotted lines in FIG. 7 illustrate both the inward and outward deflection of the rectangular cross section tube 43*b* and show that the movement of the subsections 35 is directly inward or outward. Thus, it can be seen that one advantage of the use of a closed or complete tube is to eliminate any such rotative stress at the joint.

The expansion members 43 and the cover subsections 35 can be formed from any suitable metallic material which will have adequate strength and acceptable weight characteristics. Usually, but not necessarily, the cover subsections 35 and the expansion members 43 are made from the same material, and generally steel is used. Because of their tubular shape, the expansion members 43 are "softer" and deflect by bending to change shape while the cover subsections 35 maintain their spheroidal configuration. The expansion members 43 are made of a material having an appropriate wall thickness so that for a reasonable tube depth (or diameter), a given displacement does not induce excessive stresses in the expansion members. Usually the thickness will be less than that of the cover subsections. One example of a weather cover for a spherical tank having a diameter measuring about 120 feet utilizes 9/16 inch steel plate to form the cover subsections while the expansion members 43 are steel tubes of circular cross section having a diameter of about 36 inches and a wall thickness of about ⅜ inch. The cryogenic tank 17 which is protected by the weather cover is preferably formed from plates of aluminum or low-temperature, high-nickel content steel. When steel is employed for the weather cover 13, it is coated with a protective coating that will render it resistant to the corrosive effects of the salt water atmosphere to which it will be constantly exposed. When inerting is desired, a supply of inert gas or an inert gas generating plant 49 is provided on the ship to provide inert gas to blanket the spherical tanks in the regions below the weather covers and adjacent the tanks below deck.

To facilitate movement of ship's personnel between the tops or cupolas 25 of adjacent tanks 17, without the necessity for having to descend to the deck and then climb the next tank a catwalk or walkway structure 45 is provided which bridges the gaps between the four pairs of adjacent tanks. To accommodate the catwalk structure, the expansion members 43 are provided with flattened sections 47 (see FIG. 3) just adjacent the locations where they join the collar 29. The flattened sections 47 do not significantly affect the overall deflection characteristics of the expansion members 43 and allow the stable installation of the catwalk system 45. In addition, because space aboard any ship is at a premium, the tanks 17 will accordingly be located close together, and flattened vertical sections 48 may be provided in the forward and the aft expansion members 43 adjacent where the cover meets the main deck. The flattened sections 48 provide clearance to create a passageway athwart ships between adjacent weather covers 13 along the main deck 15.

Shown in FIG. 3*a* is an alternative configuration of a weather cover 50, which is generally similar to the shell construction shown in FIG. 3, but which incorporates a further stress-relieving member. The weather cover 50 incorporates a large diameter base or bottom ring 51 which is formed from a tube of circular cross section and which extends for 360° about the lower periphery of the weather cover. Accordingly, the bottom edge of each of the cover quadrants or subsections 53 is suitably joined, as by welding, to a location on the upper surface portion of the base ring 51, and the bottom end of each of the expansion members 55 is suitably cut to mate with the annular surface of the base tube to which it is suitably joined, as by welding. In the case of the weather cover 50, instead of attaching the bottom edges of the cover subsections directly to the main deck of the ship, the connection to the main deck of the ship is made indirectly via the base ring 51. The base ring provides the additional expansion and contraction characteristics, similar to those provided by the meridional members, and thus provides additional protection against the creation of potentially destructive stress in the self-supporting plate-like cover subsections 53 as a result of the hogging and sagging of a ship in heavy seas.

Although the invention has been illustrated and described with respect to certain preferred embodiments, it should be understood that various changes and modifications as would be obvious to one having the ordinary skill in this art may be made without deviating from the scope of the invention, which is defined solely by the claims appended hereto. Various of the features of the invention are set forth in the claims which follow.

What is claimed is:

1. A liquid-transporting cargo ship comprising a hull, a main deck connected to said hull, at least one cargo tank for holding liquid disposed in said hull and extending above said main deck, and a cover surrounding the above-deck portion of said tank, said cover being generally a section of a spheroidal surface and including at least three self-supporting subsections formed of metal plating, each of which subsections is curved in two directions and is connected along its bottom edge to said main deck, and also including at least three expansion members, each expansion member being joined to the lateral edges of two adjacent subsections and being generally tubular in cross section and having a thickness less than the thickness of said cover subsections so as to resiliently deflect when subjected to stresses and thereby protect the shape of said cover subsections.

2. A ship in accordance with claim 1 wherein said expansion members have a circular or eliptical cross section and said cover subsections are joined thereto along diametrically opposite locations.

3. A ship in accordance with claim 1 wherein said expansion members have a rectangular cross section and said cover subsections are joined to opposite sidewalls along generally central locations therein.

4. A ship in accordance with claim 1 wherein a cupola is provided at the top of said cargo tank and wherein a circular opening is provided at the very top of said cover which opening is interior of a collar that is joined to the top of each of said expansion members and along the upper edge of each cover subsection.

5. A ship in accordance with claim 1 wherein said bottom edge of each of said cover subsections is directly connected to a base tubular ring and said base ring is connected to said main deck.

6. A ship in accordance with claim 1 wherein said cargo tank is adapted to carry a cryogenic liquid, wherein the joinder of said cover subsections and said expansion members is such as to render said cover gas-tight and wherein an inert atmosphere is maintained in surrounding relation to said cargo tank.

7. A ship in accordance with claim 1 wherein four cover subsections of equal size and four expansion members are provided and two of said expansion members are aligned fore-and-aft.

8. A free-standing cover for the above-deck portion of a cargo tank aboard a ship, said cover being generally a shell-like section of a spheroidal surface and comprising at least three self-supporting subsections formed of metal plating, each of which subsections is a section of a spheroidal surface curved in two directions designed for connection along its bottom edge to the main deck of the ship, and at least three expansion members made of a metallic material having a thickness less than the thickness of said cover subsections, each of which expansion members is joined to the lateral edges of two adjacent cover subsections, said expansion members being generally tubular in cross section so as to resiliently deflect when subjected to stresses and thereby protect the shape of said cover subsections.

9. A cover in accordance with claim 9 wherein said expansion members have a rectangular cross section, wherein said cover subsections are joined to opposite sidewalls along generally central locations therein in a manner to provide a gas-tight cover.

10. A cover in accordance with claim 9 wherein said expansion members are formed of closed tubes and wherein a base ring member of tubular construction is joined to the lower edge of each of said cover subsections.

11. A cover in accordance with claim 8 wherein said expansion members are substantially circular in cross section and wherein said cover subsections are joined thereto along diametrically opposite locations.

12. A cover in accordance with claim 8 wherein said expansion members are eliptical in cross section with the longer axis lying in the vertical plane and wherein said cover subsections are joined thereto along opposite locations adjacent the short axis.

13. A cover in accordance with claim 8 wherein said expansion members are closed tubes and wherein there are four cover subsections of equal size which are welded along their lateral edges to opposite locations along said expansion members.

14. A cover in accordance with claim 13 wherein the bottom edge of each of said four cover subsections is welded to a base ring in the form of a tube of circular cross section which defines the lower periphery of the free-standing cover.

* * * * *

UNITED STATES PATENT AND TRADEMARK OFFICE

CERTIFICATE OF CORRECTION

PATENT NO. : 4,106,423

DATED : August 15, 1978

INVENTOR(S) : Rolf D. Glasfeld and Jan G. Morrill

It is certified that error appears in the above–identified patent and that said Letters Patent are hereby corrected as shown below:

Column 8, line 1, change "claim 9" to --claim 8--,

Column 8, line 6, change "claim 9" to --claim 8--.

Signed and Sealed this

*First* Day of *May 1979*

[SEAL]

*Attest:*

RUTH C. MASON
*Attesting Officer*

DONALD W. BANNER
*Commissioner of Patents and Trademarks*